United States Patent [19]

Sloan

[11] Patent Number: 4,844,825

[45] Date of Patent: Jul. 4, 1989

[54] EXTREME PRESSURE ADDITIVE FOR USE IN METAL LUBRICATION

[75] Inventor: Clifford R. Sloan, Denman Island, Canada

[73] Assignee: Pro-Long Technology of Canada Ltd., Surrey, Canada

[21] Appl. No.: 121,958

[22] Filed: Nov. 18, 1987

[51] Int. Cl.[4] ..... C10M 105/05; C10M 105/72

[52] U.S. Cl. ..... 252/40.7; 252/39; 252/58

[58] Field of Search ..... 252/33, 39, 40.7, 58

[56] References Cited

U.S. PATENT DOCUMENTS

| | | | |
|---|---|---|---|
| 3,984,599 | 10/1976 | Norton | 252/32.7 E |
| 4,131,551 | 12/1978 | Thompson | 252/33 |
| 4,228,021 | 10/1980 | Lenack | 252/33.4 |

*Primary Examiner*—William R. Dixon, Jr.
*Assistant Examiner*—James M. Hunter, Jr.
*Attorney, Agent, or Firm*—Fetherstonhaugh & Co.

[57] ABSTRACT

It is known to use chlorinated paraffins as an extreme pressure lubricant additive in lubricating metals. Such additives are highly corrosive, however, and for that reason are not suitable for a number of uses, such as in the lubrication of internal combustion engines. The present invention overcomes the corrosive problems of the previous chlorinated paraffin additives. The present invention involves the mixing of a substantial portion of chlorinated paraffins with a smaller portion of an alkaline earth metal sulfonate, such as calcium or barium sulfonate, and preferably a base mineral oil and solvent. The resulting additive can be added to standard motor oil to improve its extreme pressure performance in internal combustion engines.

11 Claims, No Drawings

EXTREME PRESSURE ADDITIVE FOR USE IN METAL LUBRICATION

BACKGROUND OF THE INVENTION

1. Field of the Invention

This invention relates generally to the field of lubricant additives, and more specifically relates to the field of extreme pressure additives suitable for addition to motor oils and other lubricants.

2. Description of the Prior Art

It is known that certain chlorine-based compounds, such as those chlorine derivates of paraffinic hydrocarbon compounds referred to as chlorinated paraffins, can serve as lubricant additives to improve the performance of the lubricant under extreme pressure. Under normal lubricating conditions, the two metal surfaces will be separated by a thin film of lubricant which provides the required reduction in friction. Under situations of extreme pressure between the two metal surfaces, all the liquid lubricant is forced from the area of contact between the surfaces. Where an extreme pressure additive such as chlorinated paraffin is present, however, it has been found that the resultant heat generated between the two surfaces causes chlorine atoms to be liberated from the additive and to combine with the surface metal, such as iron, to form a chloride, such as iron chloride. This surface coating of chloride has a much lower coefficient of friction than the dry metal surface. The iron chloride surface coating tends to fill in depressions in the surfaces, resulting in smoother surfaces at the point of interaction and reduced friction and wear.

Chlorinated paraffins have been used as extreme pressure additives in such applications as metal-working. However, the corrosive nature of chlorinated paraffins have made them generally unsuitable for use in internal combustion engine applications or other corrosionsensitive applications. Under heating, the chlorinated paraffins release hydrochloric acid, which is corrosive.

SUMMARY OF THE INVENTION

The present invention provides an extreme pressure additive largely composed of chlorinated paraffins but having reduced corrosive properties. It is therefore suitable for use in internal combustion engine lubricants or other applications where corrosion must be avoided.

According to one aspect of the invention, there is provided an extreme pressure lubricant additive comprising a large amount of chlorinated paraffin and a small amount of an alkaline earth metal sulfonate, preferably calcium or barium sulfonate. A mineral oil, with or without mineral spirits, may be used as a base oil for the additive and a solvent may be added to improve the shelf life of the product. In one aspect of the invention the additive comprises between thirty and seventy volume percent chlorinated paraffins, between thirty and seventy volume percent mineral oil, mineral spirits or an aromatic solvent; and from 5 to 10 percent by volume calcium sulfonate. According to a further aspect of the invention, the additive comprises approximately 51.5 volume percent chlorinated paraffins, approximately 31 volume percent of a solvent, approximately 15.5 volume percent of a mineral oil, approximately 1 volume percent of mineral spirits and approximately 1 volume percent of a calcium sulfonate. Further according to the invention a lubricant suitable for use as a motor oil in internal combustion engines is provided by adding one part of the above extreme pressure lubricant additive to between 10 and 30 parts of standard motor oil. According to a preferred aspect of the invention, approximately one part of the extreme pressure additive is added to twenty parts standard motor oil. Also according to the invention, the above extreme pressure lubricant additive may be added to various greases, hydraulic fluid, cutting oil, gear box oil, automatic transmission fluid, air-conditioner refrigerant or penetrating oil to improve the extreme pressure performance of such lubricants. According to a further aspect of the invention, the extreme pressure lubricant additive may be added to gasoline or diesel fuel conditioners to provide an improved gasoline or diesel fuel conditioner.

Further according to the invention there is provided a method of producing an extreme pressure additive for lubricants comprising the steps of:

(a) blending 40 to 60 volume percent, preferable 51.5 volume percent, of a chlorinated paraffin with 10 to 20 volume percent, preferable approximately 15.5 volume percent, of a mineral oil;

(b) blending between 0.5 and 3 volume percent, preferable 1 volume percent, of mineral spirits and 0.5 to 10 volume percent, preferable approximately 1 volume percent, of an alkaline earth metal sulfonate and (c) blending the mixtures of steps (a) and (b) with between 20 to 40 volume percent, preferable approximately 31 volume percent, of an aromatic solvent.

A portion of the solvent may be partially mixed with the initial paraffic/mineral oil mixture.

DESCRIPTION OF A PREFERRED EMBODIMENT

The preferred form of chlorinated paraffin used in the present invention is the product marketed by C-I-L Inc. under the trade mark CERECLOR TM 63L which has a stated molecular formula of $C_{15.5}H_{26.8}Cl_{16.31}$. (The product is known to be mildly corrosive in contact with steel and to decompose into hydrochloric acid.) Other grades of CERECLOR are also suitable. The chlorinated paraffin in an amount approximately 51.5 percent by volume of the final additive product is mixed with a base mineral oil in an amount approximately 15.4 percent by volume by blending thoroughly at slow speeds to avoid foaming. The mixture may be heated to approximately 150° F. to promote the mixing process and prevent subsequent separation of the constituent components. A preferred mineral oil is marketed by Shell Canada Limited under the trade mark VITREA TM No. 220. The calcium sulfonate is next mixed separately with mineral spirits. The preferred proportion is approximately 1 percent calcium sulfonate by volume of the final additive product, and approximately 1 percent by volume of the mineral spirits. The preferred calcium sulfonate is marketed under the trade mark LUBRIZOL TM 78 by the Lubrizol Corporation. It is a highly basic calcium sulfonate, approximately 400 TBN having a calcium weight percent between 15.0 and 16.0 and a sulfur weight percent between 1.25 and 1.8. The preferred mineral spirit product is marketed by Shell Canada Limited under the trade mark SHELL SOL TM and has a composition of 89–94 percent by volume of saturates, and 6–15 percent by volume aromatics, and a maximum 0.1 percent by volume sulfur.

The calcium sulfonate/mineral spirits mixture is then blended with the chlorinated paraffin/mineral oil mixture an aromatic solvent in an amount of approximately 30.9 percent by volume of the final mixture. The purpose of the solvent is to improve the shelf life of the product by thinning the mixture so that the paraffin remains in suspension for a longer period before separating out into layers. A suitable aromatic solvent is that sold under the trade mark CYCLO-SOL TM 53 by Shell Canada Limited. In order to mask the oil and solvent smells, a small amount of an industrial scent, such as Felton TM Solvent Mask C #962 manufactured by Felton International may be added in an amount of approximately 1 litre of mask per 45 gallon drum of chlorinated paraffins. The solvent may also be partly added to the initial CERECLOR/mineral oil mixture.

The blending is preferably done so that the product is not permitted to foam. Again, the ingredients may be blended at an elevated temperature of about 150° to avoid crystallization or sedimentation of the components. The result of this final blending process is the extreme pressure additive of the invention.

A sample of the lubricant additive of the invention has provided the following analysis. These factors are variable depending on the grade of chlorinated paraffin used and the precise proportion of components.

| | |
|---|---|
| Specific Gravity @ 70° F. (21.1° C.) | 1.15 |
| Pour Point | −27° F. (−32.8° C.) |
| Viscosity @ 40° C. | 72.9 SUS (13.8 cSt.) |
| Viscosity @ 100° C. | 37.5 SUS (3.41 cSt.) |
| Flash Point (PMCC) | 108° F. (42.2° C.) |
| TBN (ASTM D2896) | 6.73 |
| Copper Corrosion (ASTM D130) for 1 hour @ 254° F. (123.3° C.) | 1a |
| Dielectric Strength | 26.5 kv |
| Water Content | 0.00% |
| Spectographic Analysis Iron | 7 |
| Chromium | 7 |
| Copper | 2 |
| Lead | 33 |
| Aluminum | 9 |
| Silicon | 4 |
| Tin | 13 |
| Sodium | 10 |
| Magnesium | 11 |
| Silver | 1 |
| Nickel | 5 |
| Zinc | 11 |
| Calcium | 1000+ |

In tests conducted, the invention has shown good compatability with all three standard types of motor oil. To test corrosion loss, mild steel blanks were left in the product for seven days at between 210° F. (98.9° C.) and 220° F. (104.4° C.). When left in ESSO UNIFLO TM 10/40 oil, there was no corrosion loss measured. When the additive of the invention was added in the amount of 6 percent by volume to the UNIFLO TM there again was no corrosion loss measured.

The effectiveness of the invention as an extreme pressure lubricant can be readily demonstrated using an extreme pressure testing machine. This machine utilizes an electric motor to rotate a steel bearing race. A stationary steel bearing is brought into contact with the rotating bearing race. This is done by removably inserting the bearing into the end of a rotating arm which is allowed to rest in contact with the rotating bearing. The arm is in turn levered by a second rotating bearing. The arm is in turn levered by a second rotating arm to the end of which weights may be applied. The effect of the arrangement of the arms is to provide a the end of the latter arm is greatly magnified through the principle of the lever through to the point of contact with the rotating bearing race. Because of the small area of contact, a very great pressure is applied by the stationary bearing to the rotating bearing race. The bearing race is initially allowed to rotate in a bath of a standard motor oil, and the end of the arm with the test bearing is allowed to rest on the rotating race without additional pressure. On examination of the test bearing, it is found that a small scar, approximately one millimeter in width is formed in the surface of the bearing due to the friction. The test bearing is then rotated to apply a fresh surface to the bearing race, and again the test bearing is allowed to contact the rotating race, only this time a weight of approximately four pounds is applied to the end of the multiple-lever apparatus to apply more pressure to the point of contact. Upon examination of the test bearing, a large scar has been formed in the surface of the bearing, approximately four millimeters in width.

The procedure is then repeated, only an amount of the extreme pressure lubricant additive of the invention is added to the motor oil bath in which the bearing race is rotating. Again, the test bearing is rotated to present a fresh surface to the bearing race and is allowed to rest in contact against the rotating race without additional pressure. Upon examination of the test bearing, it is found that the initial amount of scarring has been greatly reduced. When the test is repeated with a four-pound (1.81 kg.) weight at the end of the lever mechanism, the scarring is still less than was present in the initial oil-only situation without additional pressure, with the scar now being less than one millimeter in width. Indeed, rather than being a deep gouge out of the surface of the bearing, as was the case with the oil-only bath, the point where the test bearing contacted the bearing race rotating in the oil with additive bath appears to the eye to be a small polished area on the surface of the bearing. Even if the weight at the end of the lever mechanism is increased by a factor of six from the four-pound (1.81 kg.) weight the size of the scar on the test bearing does not increase significantly and still is not significantly greater in width then was the case with the oil-only bath where no additional pressure was added. Indeed, the surface of the scar is shown to be polished compared to the pitted scar present in the oil-only bath.

To demonstrate the lack of corrosion with compositions according to the invention, the following tests were carried out on a composition according to the invention:

Test 1

The product was tested at 150° C. for liberation of chlorine gas by two methods.

(a) When no standard methods in this area were found in the literature, a modified ASTM 1317/64 method was used:

1,00 g of a composition according to the invention was heated to 150° C. for 12 hours. The gas liberated was transferred to a solution of sodium in n-butanol. Any chlorine present is reduced to chloride in this process.

The solution was mixed with nitric acid and hexane (according to the ASTM-procedure), and separated in a separation funnel. The water phase was titrated with silver nitrate and titrated back with thiocyanate solution with iron(III)alum as indicator.

The amount of chlorine in this test was too low to be detected.

(b) 6.7 g of a composition according to the invention was heated for 2 hours at 150° C. The gas liberated was passed into a litre bottle of distilled water in a closed system. The product liberated some organic compounds into the gas phase, but free or bonded chlorine was not found using chlorine test kit, Chemetrics Modell C1-5. The limit of detection in this test is less than 0.01% of weighted sample.

Test 2

(a) The chlorides emitted from Mohawk TM 10/30 grade motor oil, Spartan TM 80/90 grade gear oil; a composition according to the invention; 15% of a composition according to the invention with 85% of 10/30 oil; and 15% of a composition according to the invention with 85% of the 80/90 oil when $N_2$ was passed through the different oils at temperatures of 71°-98° C. were measured.

(b) The oils were also analyzed for actual chloride content.

The results of the testing are as follows:

A. Chloride Emissions

| Test No. | Ingredients | Temperature Average °C. | Temperature Maximum °C. | Sample Volume L | Chloride mg | Emissions ug/Cl=L |
|---|---|---|---|---|---|---|
| 1 | 10/30 motor oil | 59 | 98 | 230 | trace | trace |
| 2 | 80/90 gear oil | 48 | 76 | 158 | 0.24 | 1.5 |
| 3 | Composition of the invention | 46 | 72 | 249 | 0.09 | 0.4 |
| 4 | 15% of composition according to the invention and 85% 10/30 | 46 | 71 | 203 | 0.18 | 0.9 |
| 5 | 15% of composition according to the invention and 85% 80/90 | 47 | 74 | 286 | 0.49 | 1.7 |

B. Chloride Content of Oil

| Oil | Cl=conc. mg/g | Cl=conc. ppm | Specific Gravity |
|---|---|---|---|
| 10/30 | 0.1 | 100 | 0.87 |
| 80/90 | 1.0 | 1,000 | 0.89 |
| Composition according to the invention | 337 | 337,000 | 1.15 |

Test 3

The following tests were performed on the indicated products.

Copper Strip Corrosion by ASTM D130, three hours at 100° C., on a composition according to the invention shows Color lb, a Pass designation.

Copper Strip Corrosion on Grease by ASTM D4048, 24 hours at 100° C., on a Grease a composition according to the invention shows "freshly polished", a Pass designation.

Rust-Preventing Characteristics by ASTM D665, 24 hours at 140° F., on Pennzoil 10w/30 motor oil, shows NO rust spots.

Rust-Preventing Characteristics, as above, on Pennzoil 10w/30 plus 10% a composition according to the invention shows NO rust spots.

Test 4

Detection of copper corrosion from blended lubrication grease by the Copper Strip Tarnish Test.

This method measures the tendency of grease to corrode copper strip under certain static conditions under various temperatures.

Procedure (3.1-ASTM-D-4048) - A prepared copper strip is totally immersed in a sample of grease heated in an oven or liquid bath for a definite period of time. Commonly used conditions are 100° C. (212° F.) for 24 hours. At the end of this period, the strip is removed, washed and compared with ASTM Copper Strip Corrosion Methods.

Preparation

A standard hectorite grease is blended with 13% E.P. additive of the invention. The cleaned copper strip was fully submerged into the grease mixture and subjected to heat at 100° C. (212° F.) for 24 hours.

Temperature—212° F. (100° C.)

Time—24 hours

The cloud pour jar was removed from the oven and allowed to cool and then the copper strip was removed and washed.

RESULTS

After 24 hours in a mixture of E.P. additive of the invention and hectorite grease, the copper strip showed no sign of corrosion.

The copper strip was compared to the ASTM Copper Strip Chart and found to be a "1-a", that is "light orange, almost the same as the freshly polished strip".

The test showed no visible signs of corrosion when the E.P. additive was blended with a multi-purpose grease.

Test 5

Detection of Corrosion from Petroleum Product Test Method by ASTM-D-130-83-Copper Strip Tarnish Test and Modified ASTM-D-130-83 using Corrosion Test on Steel Bearing Blanks Through this method of testing, the detection of corrosiveness to both copper and steel is analysed when using a mixture of automobile oil and a extreme pressure composition according to the invention.

The project was conducted to test the blended oil and an extreme pressure additive according to the invention for the effect of heat o the mixture and possible corrosion.

The oil used a standard SAE 10W30 motor oil of a API SF, SF and CC rating.

The extreme pressure lubricant was blended at a ratio of 10:1 (10% E.P. additive).

The tests were conducted with both a neat oil test and a blended oil test. All preparations were carried out according to ASTM protocol. The copper strip corrosion test bomb was used in a thermo oven set at various controlled temperatures.

TEST RESULTS

Test carried out with copper blank and then steel blank, immersed in 50 ml of neat oil or 50 ml of blended.

Test (A)

Copper blanks were polished and cleaned and tested at the following temperatures at time periods of:

1 hr. @150° F.—1 a
3 hrs. @150° F.—1 a
1 hr. @200° F.—1 a
3 hrs. @200° F.—1 b
1 hr. @300° F.—1 b Designation of Results - 1 a to 1 b -

1 - (a) - Light orange, almost the same as polished strip
1 - (b) - Dark orange

Test (B)

Copper blanks freshly polished and submersed in a mixture of motor oil and E.P. additive. The tests were conducted covering the normal manner to the extreme.

1 hr. @150° F.—1 a
3 hrs. @150° F.—1 a
1 hr. @200° F.—1 a
3 hrs. @200° F.—1 a
1 hr. @300° F.—1 a
3 hrs. @300° F.—1 a
24 hrs. @300° F.—1 b Test (C)

Steel bearing blanks were freshly polished and cleaned in Stoddards solvent. The steel blanks were immersed in real motor oil and heated with the following results:

1 hr. @150° F.—no corrosion detected
3 hrs. @150° F.—no corrosion detected
1 hr. @200° F.—no corrosion detected
3 hrs. @200° F.—no corrosion detected
1 hr. @300° F.—no corrosion detected
3 hrs. @300° F.—no corrosion detected Test (D)

Steel bearing blanks were polished and cleaned in Stoddards solvent. The bearings were then subject to the various temperatures while submerged in a mixture of motor oil and a 10% mixture of E.P. additive according to the invention. The tests were conducted with detection of corrosion in mind.

1 hr. @150° F.—no corrosion detected
3 hrs. @150° F.—no corrosion detected
1 hr. @200° F.—no corrosion detected
3 hrs. @200° F.—no corrosion detected
1 hr. @300° F.—no corrosion detected
3 hrs. @300° F.—no corrosion detected
24 hrs. @300° F.—no corrosion detected

*At 24 hours of testing a small amount of carbon residue was found to be collected on the bearing but quickly dissolved when the bearing was removed and cleaned in Stoddards solvent. No noticeable amount of corrosion was detected.

The same motor oil was subjected to the 24 hour heat test at 300° F. (149° C.). The results on both the copper strip (blank) and the steel bearing blank were severe corrosion and damage. As noted above, the addition of the E.P. additive according to the invention controlled the effect that long term heat had upon the sample metals. Thus, the E.P. additive gave the oil better thermal stability and an increased oxidation factor.

RESULTS

The results showed only marginal change of appearance of either the copper blanks or the steel bearing blanks.

Test 5

ASTM-D-665-83

Standard Testing Method for Rust Preventing Characteristics of Inhibited Mineral Oil in the Presence of Water

PHASE I

This method determines the ability of an inhibited mineral oil to resist from rusting or corrosion when water becomes mixed with the oil. Copper strips are prepared according to ASTM procedures.

Test (A)—Uninhibited mineral oil and copper blank with 35% distilled water.

Test (B)—Uninhibited mineral oil (10% E.P. additive according to the invention added to uninhibited mineral oil) and copper blank with 35% water added.

Both tests were subjected to open cloud pour breaker test, fully submerged in the oil. The tests were subjected to 100° C. (212° F.) for a 24 hour period. The copper strips were removed and washed with the Stoddards solvent. Both copper strips were viewed as follows:

(A) Copper strip in uninhibited mineral oil (1-b)
(B) Copper strip in uninhibited mineral oil (1-b)

Designation (1-b) Dark orange but only slight tarnish.

The copper strips are compared to the ASTM Copper Strip Comparison Chart.

PHASE II

This method is to determine the corrosive effect when a saline solution is added to uninhibited mineral oil and to an inhibited mineral oil. The inhibited mineral oil contains 10% solution of E.P. additive according to the invention.

The uninhibited and the inhibited mineral oil are then placed in separate 500 ml cloud pour breaker and 30 ml of a saline solution is added to both beakers. Polished steel probes are then suspended in the beakers and the beakers are placed in an oven at 60° C. (140° F). The steel specimens are allowed to remain in the solution for 24 hours before being removed and washed. After washing of the steel probes, they are examined for visual signs of corrosion.

Results

C—Uninhibited mineral oil with 10% saline solution. On completion of the test, the steel probes were examined and found free of corrosion.

D—Inhibited mineral oil (10% E.P. additive according to the invention) and 10% saline solution for 24 hours at 60° C.

On completion of the test, the steel probes were examined and found free of corrosion.

Evaluation according to ASTM-D-665-83

After examining the probes subjected to the saline and oil solution containing the extreme pressure additive, no corrosive effect was created by the use of this product.

Extreme Testing

After removing the probes, they were re-inserted into their previous solution for 20 minutes and then transferred into a mild solution of sulfuric acid. The steel probes were allowed to stand for twelve hours and examined.

Effects of Sulfuric Acid Solution

Slight to mild discoloration was evident on both probes but no serious or detrimental effect upon the probe that had been subjected to the E.P. additive solution.

In addition to serving as an extreme pressure additive for motor oils, the lubricant additive of the invention may also be added to other lubricants and fluids such as greases, (where approximately 10 percent by volume of the additive is preferred), metal cutting lubricants, industrial gear lubricants, hydraulic oils (excluding hydraulic brake fluid), automatic transmission fluid, power steering fluid, penetrating oil, airconditioner refrigerant, and as a coating for brass. In all these applications, the additive of the invention serves to reduce friction and metal wear under extreme pressure situations, and also serves to reduce corrosion. It has also been found that by adding the extreme pressure additive product of the invention to a gasoline or diesel fuel conditioner, the performance of the internal combustion engine is improved through lubrication of the moving metal parts which come into contact with the fuel in the upper end of the engine.

While calcium sulfonate has been specified as the appropriate sulfonate to counteract the corrosive properties of the chlorinated paraffins, other alkaline earth metal sulfonates having similar properties, such as barium sulfonate, would also be suitable for use in the invention. While a preferred embodiment of the invention has been described, the scope of the invention should not be limited thereto but is defined by the following claims.

The embodiments of the invention in which an exclusive property or privilege is claimed are defined as follows:

1. An extreme pressure lubricant additive consisting essentially of:

(a) between 30 and 70 volume percent chlorinated paraffin;

(b) between 30 and 70 volume percent of a component selected from the group consisting of mineral oil, mineral spirits and an aromatic solvent; and (c) between 0.5 and 10 volume percent of an alkaline earth metal sulfonate.

2. The extreme pressure lubricant additive of claim 1 wherein said chlorinated paraffin comprise approximately 50 percent by volume of said extreme pressure lubricant additive.

3. The extreme pressure lubricant additive of claim 2 wherein said alkaline earth metal sulfonate comprises between 1 and 3 percent by volume of said extreme pressure lubricant additive.

4. The extreme pressure lubricant additive of claim 1 wherein said alkaline earth metal sulfonate is calcium sulfonate or barium sulfonate.

5. An extreme pressure lubricant additive consisting essentially of:

(a) approximately 51.5 percent by volume of a chlorinated paraffin;

(b) approximately 31 percent by volume of an aromatic solvent;

(c) approximately 5.5 percent by volume of a mineral oil;

(d) approximately 1 percent by volume of calcium sulfonate; and (e) approximately 1 percent by volume of mineral spirits.

6. A motor oil comprising:

(a) between ten and thirty parts by volume of a conventional motor oil; and (b) one part by volume of the extreme pressure lubricant additive as defined in claim 1.

7. A method of producing an extreme pressure lubricant additive comprising the steps of:

(a) blending 40 to 60 volume percent of chlorinated paraffin with 10 to 20 volume percent of a mineral oil;

(b) blending between 0.5 and 3 volume percent of a mineral spirit with 0.5 to 10 volume percent of an alkaline earth metal sulfonate; and (c) blending the mixtures of steps (a) and (b) with between 20 and 40 volume percent of a aromatic solvent.

8. The method of claim 7 wherein said alkaline earth metal sulfonate is calcium sulfonate or barium sulfonate.

9. A method of producing an extreme pressure lubricant comprising the steps of:

(a) blending approximately 51.5 volume percent chlorinated paraffin and approximately 15.5 volume percent mineral oil;

(b) blending approximately 1 volume percent mineral spirits and 1 volume percent of an alkaline earth metal sulfonate; and (c) blending the mixtures of steps (a) and (b) with approximately 31 volume percent of an aromatic solvent.

10. The method of claim 9 wherein said alkaline earth metal sulfonate is calcium sulfonate or barium sulfonate.

11. A motor oil comprising:

(a) twenty parts by volume of a conventional motor oil; and (b) one part by volume of the extreme pressure lubricant additive of claim 1.

* * * * *

UNITED STATES PATENT AND TRADEMARK OFFICE

CERTIFICATE OF CORRECTION

PATENT NO. : 4,844,825

DATED : July 4, 1989

INVENTOR(S) : Clifford R. Sloan

It is certified that error appears in the above-identified patent and that said Letters Patent is hereby corrected as shown below:

Title page, insert the following:

--Related U. S. Application Data

[63] Continuation-in-part of Ser. No. 840,897, Mar. 18, 1986.--.

Column 1, following the title and before the BACKGROUND OF THE INVENTION add,

--REFERENCE TO RELATED APPLICATION

This application is a continuation-in-part of application 840,897 filed 18 March 1986, the disclosure of which is incorporated by reference.--

Signed and Sealed this

Thirteenth Day of October 1998

*Attest:*

Bruce Lehman

BRUCE LEHMAN

*Attesting Officer*

*Commissioner of Patents and Trademarks*